US005122625A

United States Patent [19]

Kobayashi et al.

[11] Patent Number: 5,122,625

[45] Date of Patent: Jun. 16, 1992

[54] CIRCUIT BREAKER

[75] Inventors: Yoshiaki Kobayashi; Mitsugu Takahashi; Takao Mitsuhashi, all of Amagasaki; Shinji Yamagata, Fukuyama, all of Japan

[73] Assignee: Mitsubishi Denki Kabushiki Kaisha, Tokyo, Japan

[21] Appl. No.: 578,269

[22] Filed: Sep. 6, 1990

[30] Foreign Application Priority Data

Sep. 18, 1989 [JP] Japan ..... 1-241357

[51] Int. Cl.[5] ..... H01H 33/04; H01H 1/00

[52] U.S. Cl. ..... 200/144 R

[58] Field of Search ..... 200/144 R-151; 335/8-10, 201

[56] References Cited

U.S. PATENT DOCUMENTS 3,632,930 1/1972 Parini ..... 200/146 R
4,409,572 10/1983 Mostosi ..... 335/8
4,849,590 7/1989 Becker et al. ..... 200/147 R

FOREIGN PATENT DOCUMENTS 57-45007 9/1982 Japan .

*Primary Examiner*—J. R. Scott
*Attorney, Agent, or Firm*—Burns, Doane, Swecker & Mathis

[57] ABSTRACT

In a circuit breaker of double break type, a first moving contact arm and a second moving contact arm are pivoted on a common pin shaft in a manner to move mechanically independent from each other and are electrically connected at the parts near the pivoted ends by a flexible conductor, such as a braided wires, and thereby stable and reliable contacts of the moving contacts on the stationary contacts are assured.

5 Claims, 5 Drawing Sheets

CIRCUIT BREAKER

FIELD OF THE INVENTION AND RELATED ART STATEMENT

1. Field of the Invention

The present invention relates to an improvement in a circuit breaker of double break type which has serially connected two sets of contacts for each phase. The invention relates particularly to the configuration of moving contact arm in the circuit breaker of the double break type.

2. Description of the Related Art

A circuit breaker of the double break type has been disclosed, for instance, in the Japanese published examined patent application Sho 57-45007 (Tokko-Sho 57-45007). The essential parts thereof are shown herein by FIG. 5 and FIG. 6. As shown in these drawings, first stationary contact holder 1 having a first stationary contact 2 and a second stationary contact holder 8 having a second stationary contact 7 are disposed parallel and in opposite directions to each other. An integral U-shaped moving contact arm is comprised of a first moving contact arm 4, a second moving contact arm 5 and a connecting part 9 that integrally connects the first and the second moving contact arms 4, 5, and has a first moving contact 3 and a second moving contact 6, respectively. The first and second moving contact arms 4, 5 are provided movably above the first stationary contact holder 1 and the second stationary contact holder 8, in a manner that the first moving contact 3 and the second moving contact 6 contact the first stationary contact 2 and the second stationary contact 7, respectively, when the moving contact arms 4, 5 are driven down by a known driving member (not shown). The moving contact arms 4, 5 are movably pivoted by a pin 10. A torsion spring 11 is provided and is coupled at one end thereof to a part of the first moving contact arm 4, at the other end to an arm 121 of a driving member 120 and at its middle wound part to the pin 10, thereby urging the first and the second moving contact arms 4, 5 downward to the stationary contacts 2, 7, respectively. The above-mentioned components are assembled on a base casing 12 which is made of an insulative plastic material. The base casing 12 has a partition wall 15 thereon for defining a first arc extinguishing space 13 on one side thereof and a second arc extinguishing space 14 on the other side thereof. The driving member 120 is linked to a known driving mechanism such as a tripping mechanism or remote driving electromagnet through a known cross bar 123, usually, and the cross bar 123 usually links similar driving members in the three similar circuit breakers of three phases.

The above-mentioned general double break type circuit breaker operates as follows. When the moving contact arms 4, 5 are in the closing state wherein the first moving contact 3 and the second moving contact 6 contact the first stationary contact 2 and the second stationary contact 7, respectively, the current flows from the first stationary contact holder 1, through the first stationary contact 2, the first moving contact 3, the first moving contact arm 4, the connecting part 9, the second moving contact arm 5, the second moving contact 6, the second stationary contact 7 and to the second stationary contact holder 8, or in the opposite direction to the above. To break the circuit, the moving contact arms 4, 5 are driven in clockwise direction in the drawings by a known driving mechanism (not shown). Then, the moving contacts 3 and 6 depart from the stationary contacts 2, 7, respectively, and arcs are generated between the parting contacts 3 and 2 as well as the other parting contacts 6 and 7. Since the two contact pairs 3-2 and 6-7 are each other isolated by the partition wall 15, two arcs generated between each contact pairs are in series-connected relation. Because there are two arcs in series the total length of the arc column is as long as twice of that of the single contact type circuit breaker. Thus, the configuration of this double break type circuit breaker can raise the arc voltage at a rate (or speed) as high as twice of that of the single contact type breaker. Therefore, its current is quickly suppressed and the breaking time is sufficiently short, and there is only small damage in the double break type circuit breaker. However, the above-mentioned conventional double break type circuit breaker has a problem that contact pressures in two contact pairs, namely first contact pair 2 and 3 and the second contact pairs 6 and 7 are likely to have different contact pressure, for one reason or another. The cause may be, for instance, a delicate initial difference in the faces of the contacts, or difference of surface consumption of the contacts, etc. Such difference of the contact pressure is substantially not adjustable, because the moving contact arms 4 and 5 are rigidly and integrally connected with each other by the connecting part 9, and therefore the contact is liable to become unstable.

OBJECT AND SUMMARY OF THE INVENTION

In order to solve the above-mentioned problem, the present invention is intended to provide an improved circuit breaker to achieve more stable contact by both pairs of contacts of the double break type circuit breaker.

The above-mentioned problem is achieved by the circuit breaker in accordance with the present invention, which comprises:

a first stationary contact holder which has a first stationary contact at one end thereof, a second stationary contact holder which has a second stationary contact at one end thereof and disposed substantially in parallel and opposite direction to the first stationary contact holder.

a first moving contact arm which has a first moving contact at the moving end part thereof, a second moving contact arm which has a second moving contact at the moving end part thereof and disposed substantially parallel and in the same direction with regard to the first moving contact arm, and a flexible conductor for electrically connecting parts of opposite ends to the moving ends of the first moving contact arm and the second moving contact arm in a manner to allow mechanically free motions thereof from the other.

By provision of the flexible conductor for electrically connecting parts of opposite ends to the moving ends of the first moving contact arm and the second moving contact arm, the first moving contact arm and the second moving contact arm can move mechanically free from each other, and thereby, appropriate contact pressures are provided for respective contact points pair in the double break type circuit breaker.

It will be recognized that some or all of the Figures are schematic representations for purposes of illustration and do not necessarily depict the actual relative sizes or locations of the elements shown.

DESCRIPTION OF THE PREFERRED EMBODIMENTS

Figure 1:
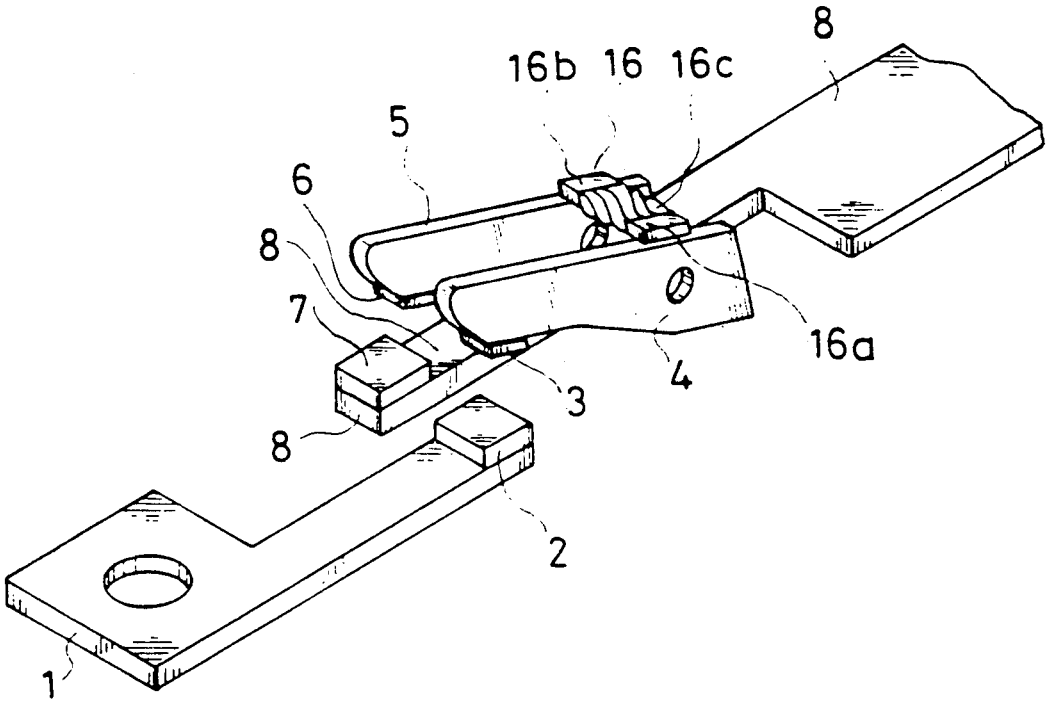
FIG. 1 is a perspective view of an essential part of a circuit breaker embodying the present invention.
Figure 2:
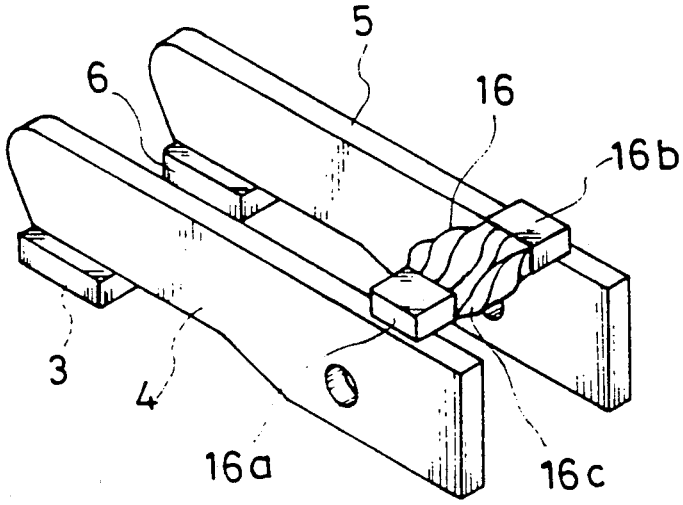
FIG. 2 is a perspective view for showing detailed configuration of the part of mechanically free and electrically connected part of the constitution shown in FIG. 1.
Figure 3:
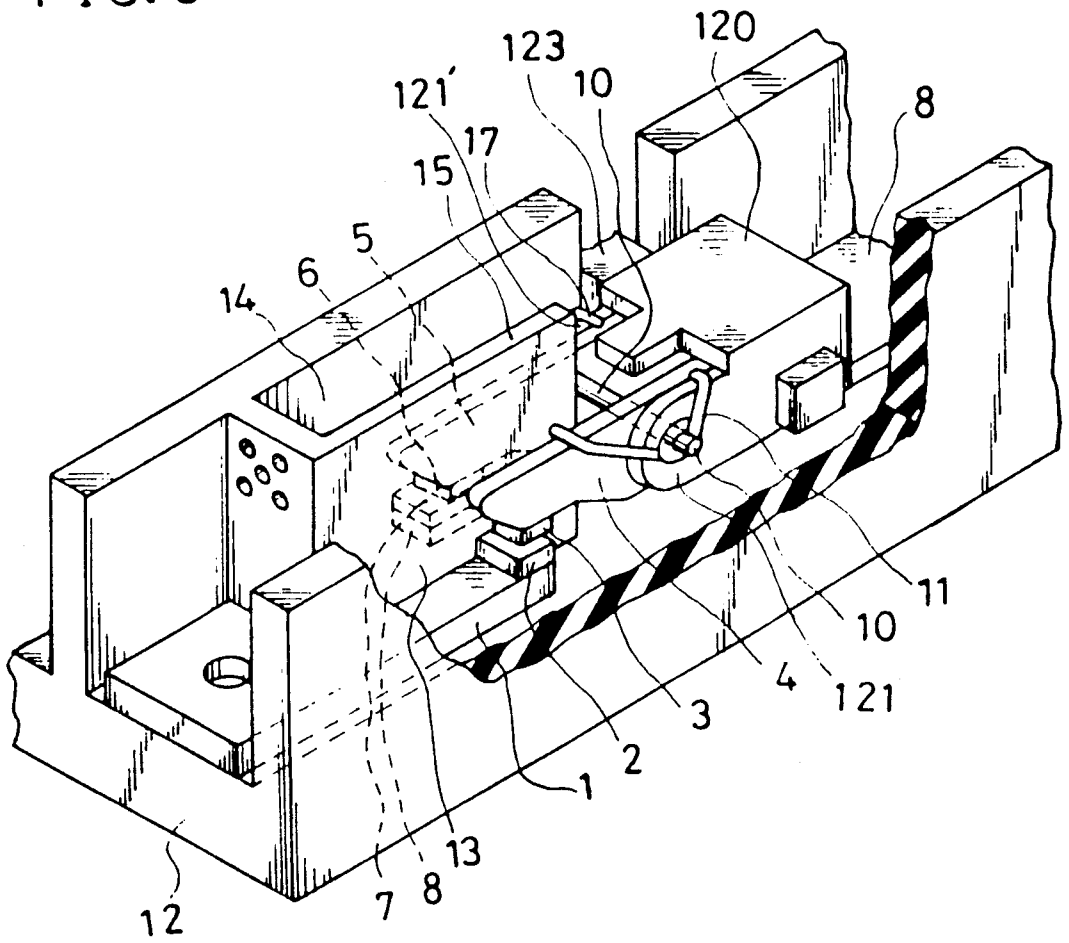
FIG. 3 is a perspective view, partially broken, of the circuit breaker of the embodiment of FIG. 1 shown with its cover plate removed.
Figure 4:
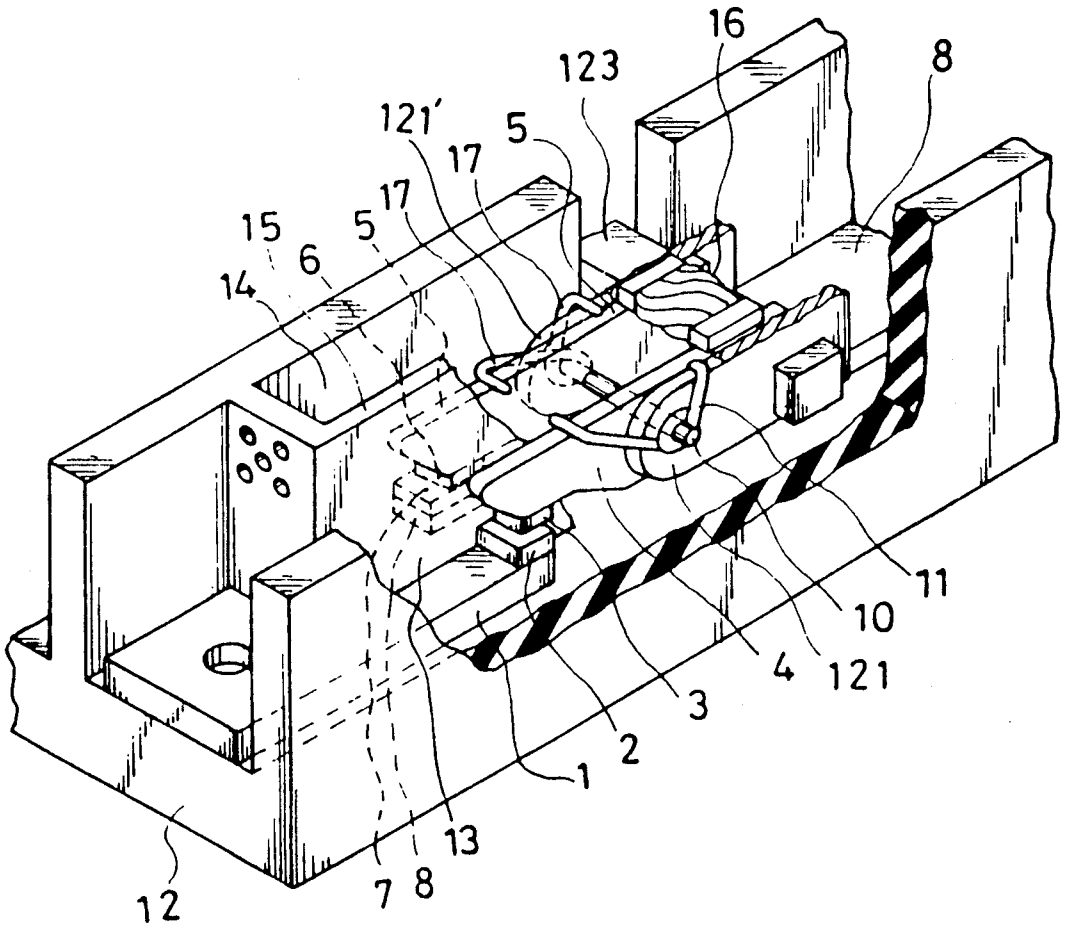
FIG. 4 is a perspective view, partially broken of the circuit breaker of the embodiment shown with its partition wall and driving member partly removed.
Figure 5:
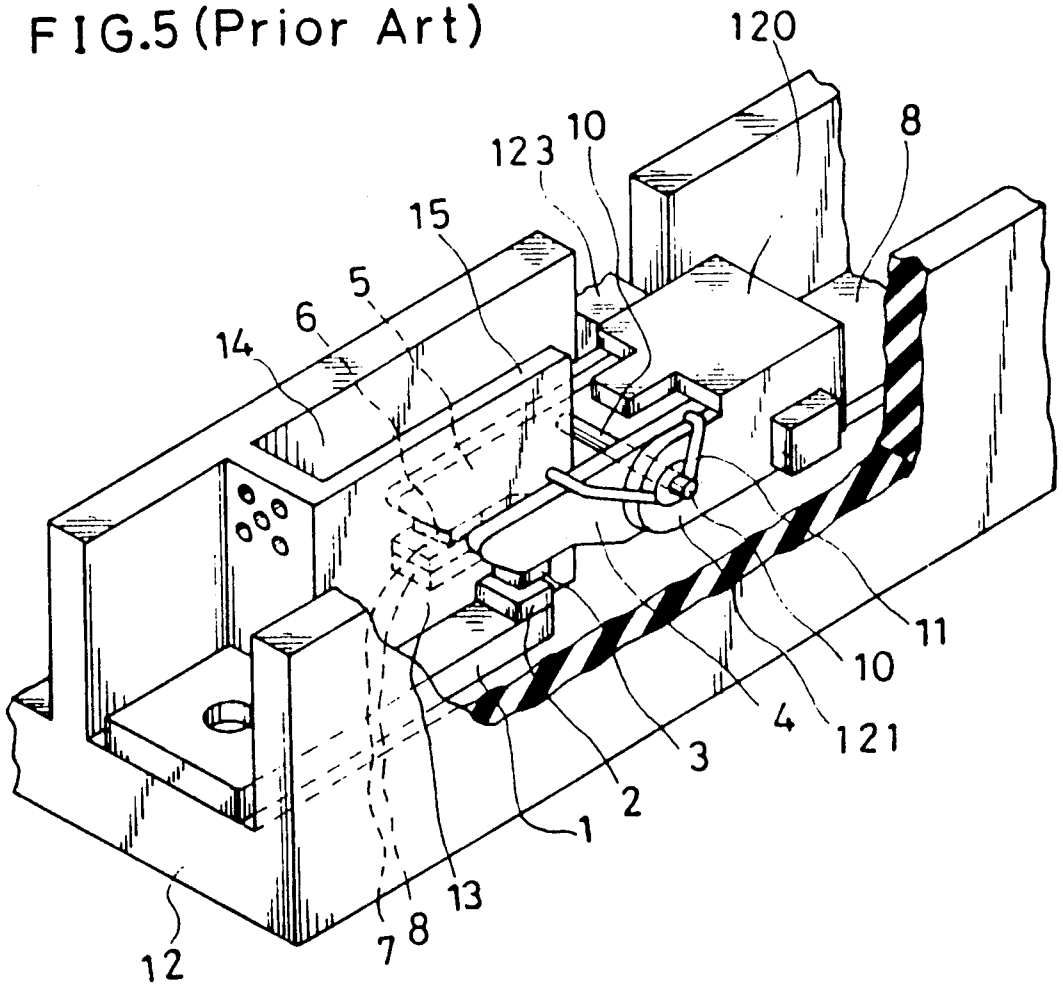
FIG.5 (Prior Art)
FIG. 5 is the perspective view of the essential part of the circuit breaker of the prior art.
Figure 6:
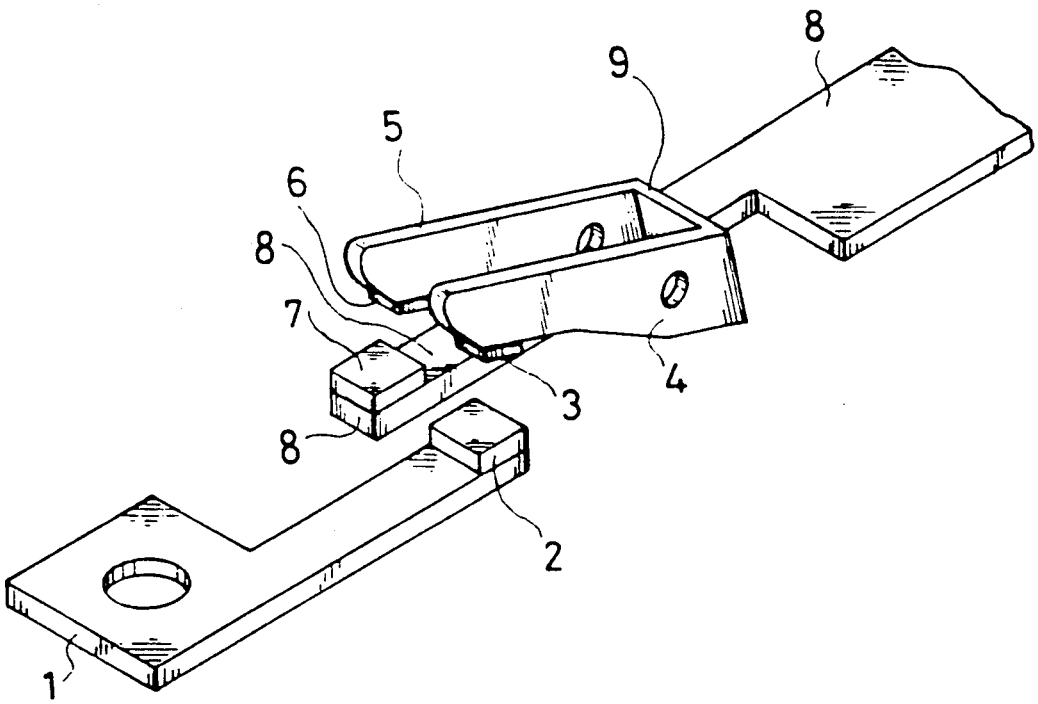
FIG. 6 (Prior Art)
FIG. 6 is the perspective view for showing detailed configuration of the part of the integral rigid mechanical connection part of the moving contact arms.

A preferred embodiment of the present invention is elucidated with reference to the accompanying drawings FIG. 1, FIG. 2, FIG. 3 and FIG. 4.

As shown in these drawings, first stationary contact holder 1 having a first stationary contact 2 and a second stationary contact holder 8 having a second stationary contact 7 are disposed parallel and in opposite directions to each other. A pair of parallel disposed moving contact arms, namely a first moving contact arm 4 and a second moving contact arm 5 are pivoted by a pin 10 to a driving member 120. The first moving contact arm 4 and the second moving contact arm 5 are electrically connected by a flexible conductor 16, for instance braided wires **16*c* whose both ends are hardened by, for instance, high temperature heating and pressing, to form hard end parts 16*a* and 16*b*. Alternatively, the hardened parts 16*a* and 16*b* may be hardened by silver-soldering. The hardened ends of the braided wires are electrically and mechanically fixed by welding or silver-soldering to the upper edge parts near the pivoted ends of the first moving contact arm 4 and the second moving contact arm 5, respectively. Thus, the first and second moving contact arms 4, 5 are held movably above the first stationary contact holder 1 and the second stationary contact holder 8, in a manner that the first moving contact 3 and the second moving contact 6 contact the first stationary contact 2 and the second stationary contact 7, respectively, when the moving contact arms 4, 5 are driven down by a known driving member (not shown). The moving contact arms 4, 5 are movably pivoted by a pin 10. A torsion spring 11 is provided being coupled at one end thereof to a part of the first moving contact arm 4, at the other end to an arm 121 of a driving member 120, and at its middle wound part to the pin 10, thereby urging the first moving contact arm 4 downward to the first stationary contact 2 so as to provide a contact pressure therebetween. Similarly, the other torsion spring 17 is provided being coupled to a part of the second moving contact arm 5, the other arm 121' of the driving member 120, and the wound medium part around the pin 10, thereby urging the second moving contact arm 5 downward to the second stationary contact 7 so as to provide another contact pressure therebetween. The above-mentioned components are assembled on a base casing 12 which is made of an insulative plastic material. The base casing 12 has a partition wall 15 thereon to define a first arc extinguishing space 13 on one side thereof and a second arc extinguishing space 14** on the other side thereof.

The driving member 120 is linked to a known driving mechanism, such as a tripping mechanism or a remote driving electromagnet, through a known cross bar 123. Usually, the cross bar 123 links similar driving members of three similar circuit breakers of three phases.

The above-mentioned general double break type circuit breaker operates as follows. To close the circuit breaker, the moving contact arms 4, 5 are driven counter-clockwise by the driving member 120 to the closing state, wherein the first moving contact 3 and the second moving contact 6 contact the first stationary contact 2 and the second stationary contact 7, respectively. Then, the current flows from the first stationary contact holder 1, through the first stationary contact 2, the first moving contact 3, the first moving contact arm 4, the flexible conductor 16, the second moving contact arm 5, the second moving contact 6, the second stationary contact 7 and to the second stationary contact holder 8, or in the opposite direction to the above. To break the circuit, the moving contact arms 4, 5 are driven in clockwise direction in the drawings by the known driving mechanism. Then, the moving contacts 3 and 6 depart from the stationary contacts 2, 7, respectively, and arcs are generated between the parting contacts 3 and 2 as well as the other parting contacts 6 and 7. Since the two contact pairs 3-2 and 6-7 are each isolated by the partition wall 15 and the distance of twice length of the moving contact arms 4, 5, the two arcs generated by the contact pairs are each isolated, and hence are in series-connected relation. Therefore, total length of the arc columns is as long as twice of that of the single contact type breaker.

According to the above-mentioned configuration of the present invention, since the first moving contact arm 4 and the second moving contact arm 5 are pivoted separately from each other on a pin 10, urged by respective contact pressure springs 11 and 17 and are connected with each other by the flexible conductor (such as the braided wires **16*c*), both the moving contact arms 4 and 5 are freely movable from each other in a rotational way around the pin 10 (or vertically) in the direction to apply contact pressure to the stationary contacts 3 and 6, respectively, in a left or right direction slightly, and even obliquely, slightly, from the vertical face of the moving contact arms 4, 5 when a predetermined tolerance is provided between the pin 10 and the holes on the moving contact arms 4, 5. A stable and appropriate impression of contact pressure from the moving contacts 3 and 6 to the stationary contacts 2 and 7**, respectively, is achievable.

Furthermore, since the first and the second moving contact arms 4 and 5 are electrically connected by a flexible conductor 16, such as the braided wires, at the opposite end parts to the moving parts where the moving contact points are fixed, namely at the distant part from the contact pairs 3-2 and 6-7, substantially the total length of the moving contact arms 4 and 5 can be utilized as insulation distance between the two arcs.

Furthermore, by welding or soldering the hardened end parts **16*a*, 16*b* of the flexible conductor 16*c* at the upper edges of the above-mentioned opposite end parts of the moving contact arms 4 and 5, the flexible conductor 16 is short and straight without forced sharp bending and hence can smoothly follow the movement of the moving contact arms 4, 5**. Therefore, the welded part or soldered part has large and stable strength for long service time.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A circuit breaker comprising:

a first stationary contact holder which has a first stationary contact at one end thereof, a second stationary contact holder which has a second stationary contact at one end thereof, said first and second stationary contact holders being disposed substantially parallel and in opposite directions to one another, a first moving contact arm having a moving end part, said first moving contact arm having a first moving contact at the moving end part thereof, a second moving contact arm having a moving end part, said second moving contact arm having a second moving contact at the moving end part thereof, said second moving contact arm being disposed substantially parallel and in the same direction with regard to said first moving contact arm, said first and second moving contact arms being mounted to allow movement of said first and second moving contact arms relative to one another, a flexible conductor for electrically connecting said first moving contact arm to said second moving contact arm in a manner that permits mechanically free motion between the first and second moving contact arms.

2. A circuit breaker in accordance with claim 1, which further comprises:

a first spring for providing a first contact force to said first moving contact arm to make said first moving contact contact said first stationary contact, and a second spring for providing a second contact force to said second moving contact arm to make said second moving contact contact said second stationary contact.

3. A circuit breaker in accordance with claim 1 or 2 wherein said flexible conductor includes braided wires.

4. A circuit breaker in accordance with claim 1 wherein said first moving contact arm and said second moving contact arm are fulcrumed by a pin with a predetermined tolerance for a predetermined limited motion in a direction other than the direction of rotation around the axis of said pin.

5. A circuit breaker in accordance with claim 1 or 2, wherein said flexible conductor includes braided wires; and said first moving contact arm and said second moving contact arm are fulcrumed by a pin with a predetermined tolerance for a predetermined limited motion in the other direction than the rotation around the axis of said pin.

* * * * *